US005526625A

United States Patent [19]

Emblin et al.

[11] Patent Number: 5,526,625

[45] Date of Patent: Jun. 18, 1996

[54] BUILDING PANEL AND BUILDINGS USING THE PANEL

[75] Inventors: Alan G. Emblin, Tewantin; Ian A. Kilpatrick, Cash Road Eumundi, both of Australia

[73] Assignee: Building Solutions Pty Ltd., Noosaville, Australia

[21] Appl. No.: 196,228

[22] PCT Filed: Sep. 24, 1992

[86] PCT No.: PCT/AU92/00511

§ 371 Date: Oct. 6, 1994

§ 102(e) Date: Oct. 6, 1994

[87] PCT Pub. No.: WO93/06316

PCT Pub. Date: Apr. 1, 1993

[51] Int. Cl.[6] ..... E04B 1/16

[52] U.S. Cl. ..... 52/437; 52/281; 52/270; 52/309.9; 52/580; 52/92.1; 52/715; 52/742.15; 52/793.11

[58] Field of Search ..... 52/281, 580, 715, 52/806, 807, 309.4, 309.6, 309.9, 92.1, 437, 259, 270, 742.15, 745.1, 793.11

[56] References Cited

U.S. PATENT DOCUMENTS

| | | | |
|---|---|---|---|
| 2,332,732 | 10/1943 | Laucks | 52/807 X |
| 3,665,662 | 5/1972 | Timbrook et al. | 52/92.1 X |
| 3,992,829 | 11/1976 | Schellberg et al. | 52/580 X |
| 4,280,307 | 7/1981 | Griffin | 52/92.1 |
| 4,373,313 | 2/1983 | Nash, Jr. | 52/281 X |

FOREIGN PATENT DOCUMENTS

| | | | |
|---|---|---|---|
| 245352 | 6/1963 | Australia | 52/309.4 |
| 6602198 | 8/1966 | Netherlands | 52/309.4 |
| 1177784 | 1/1970 | United Kingdom | 52/806 |

*Primary Examiner*—Carl D. Friedman
*Assistant Examiner*—Yvonne Horton-Richardson
*Attorney, Agent, or Firm*—Oblon, Spivak, McClelland, Maier & Neustadt

[57] ABSTRACT

A building panel (10, 85) having a core (13, 85) between facing sheets (11, 12, 88, 89) with parallel channels through the core (13, 85) which are used for structural framework (23, 26) of the building. Either of framing such as timber and steel, or concrete (87) can be interacted with the channels in construction of a building. The panels can be used as formwork for floors (131), ceilings, roofs and walls (102, 103, 109, 118) using concrete as the structural element.

24 Claims, 11 Drawing Sheets

BUILDING PANEL AND BUILDINGS USING THE PANEL

TECHNICAL FIELD

THIS INVENTION relates to building panels, buildings and building systems using the panels. In particular, the invention relates to a cored or channelled panel and systems which utilize the cored or channelled character of the panel to erect buildings and the like.

BACKGROUND ART

Many factory formed panels are used in the building industry by which a wall, roof, etc. is formed for a building. Systems employing modular units that are prefabricated to enable creation of a range of architecturally varied buildings are known. With all such panels and systems, efforts have been made to reduce input material costs, to improve fabrication techniques so as to reduce production costs, and to adapt the characteristics of the prefabricated elements to reduce on-site handling problems and make erection of buildings less dependent on skilled trades.

DISCLOSURE OF THE INVENTION

The present invention has as its object to further improve building systems with a novel form of panel to be used in erection of buildings which panel provides for improved constructions using the panel.

Other objects and various advantages of the present invention will hereinafter become apparent.

The invention achieves its object by the provision of a building panel which may be used in the construction of floors, walls, roofs and ceilings of buildings comprising:

spaced apart first and second facing sheets; and a core therebetween;

the first and second sheets being bonded to the core;

characterised in that:

the core being crossed in at least one direction by a plurality of channels therethrough; and the channels are dimensioned to pass or receive therein structural building elements or concrete.

In addition to the above defined panel, the invention provides novel building structures utilizing the panel as will be described hereinafter.

Further, the invention also provides novel methods of establishing buildings utilizing the above described panels which will also be described in greater detail hereinafter.

The facing sheets above might be fiber cement sheets, plasterboard sheets, plywood, and the like, with or without surface treatments suited to the use of the panel. The facing sheets may be chosen for their structural characteristics when a stressed skin effect is desired in the panel. The thickness of the facing sheets will depend on the use of the panel, the material of the sheet and what construction technique is used in construction of a building using the sheet.

The core above may take a variety of forms, depending on the application of the panel. The core may comprise a foam infill which has been carved out internally to create channels. It may be composed of an array of elongate blocks of material such as foam which are spaced apart to create voids or channels therebetween. It may be composed of an array of spaced apart blocks of material, spaced to create channels therebetween overlaid with a sheet or layer of insulation material, such as a heat insulating material, such as plastic foam and the like. The aforesaid sheet of insulation material is provided in a thickness suited to the degree of insulation required and the material which is chosen will be chosen for its insulation characteristics. The aforesaid sheet of material might substitute for one of the facing sheets above. The core might be comprised of a spaced linear array of parallel elongate spacers of a material such as steel in shapes such as C-sections.

The channels above may be voids between blocks or lengths of core material or hollows cored out of a block of material. The channels might have a width equal to the width of the core, or they might extend only part way across the core. The channels might be provided in two directions across the panel to enable inserts, passage of services, or flow of concrete across the width of the panel as well as across its height.

By use of the above panels, a building can be erected wherein structural members required to support loads may be passed through selected channels of a panel to engage with other elements at opposite edges of the panel to establish a structural framework which is walled in by the panels. In establishing a wall with the panel, timber or steel may be passed through channels in the panel with the lower ends attached to a floor, or the like, and the upper end to a roof member to create a structural framework akin to what is now used, with the vertical members being passed through the channels of panels which fill out the wall. The panel member can be fabricated with facing surfaces as desired and preferably the panels are faced with materials providing a skin that can withstand stresses therein so that the core of the panel may be a standard foam material wherein channels may be established by spacing blocks of foam or they may be readily formed using a hot wire or extrusion techniques, etc. The channels may be parallel and arrayed across the width of the panel at regularly repeated intervals in at least one direction and modular construction techniques utilizing the panels can be adopted. The panels may be constructed from an assembly of materials, which materials are suited to a builder's usual set of tools.

In an alternate use of the panel, rather than traversing the panel with lengths of timber, steel, etc., to create the structural load bearing capability of the wall or building frame work, the panels can be used to establish a formwork with an exposed core into which concrete may be poured to establish structural strength akin to a hollow block construction as will be hereinafter described in greater detail.

In a further technique with concrete the panel is used in construction of a floor, ceiling or roof. The panel is utilized in a manner which has it performing the function of traditional formwork. Concrete may be poured over the upper surface of a panel with various of its voids exposed to permit concrete flow therein to establish beams. The pour might be continued so as to establish a considerable slab with beams thereunder. Reinforcing rods may be added as will be described in greater detail below.

BRIEF DESCRIPTION OF THE DRAWINGS

The invention will now be described with reference to various preferred embodiments as shown in the accompanying drawings, in which.

The drawings are not to scale, being schematic layouts to indicate the nature of the features of the invention which give rise to its advantageous attributes. Actual proportions will vary according to engineering requirements in any particular building. In concrete construction, the pattern of reinforcements will be varied to suit by construction engineers. What is illustrated is presented merely to indicate the nature of the advances in the art which are the subject matter of this specification.

Figure 1:
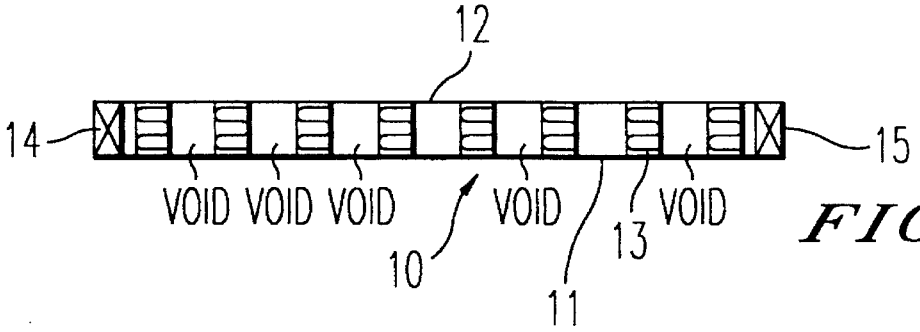
FIGS. 1 to 11 show various sections through panels and walls constructed in accordance with the present invention wherein timber, steel and the like, provides for load bearing.

In FIG. 1 is shown a transverse section through a panel 10 established between facing sheets 11 and 12 with spacers 13 leaving voids therebetween. The spacers might be a foam material and the sheets can be any of the standard sheets such as plasterboard, plywood, cement sheet, etc. The actual materials used will depend on application and factors such as nature of use, environment, and loadings, and what additional treatments might be planned, such as what decorative surface coatings might be used. The facing sheets might be a composite built of layers selected for their respective properties and laminated for use in production of the panel. In some applications, the facing sheets might be chosen for their sheet properties as a structural skin adding to the structural properties of the assembled buildings. In other applications, the facing sheets may only serve as formwork for a concrete infill which is designed to meet structural requirements. Those skilled in the art will appreciate that the panel materials and dimensions might be varied to accommodate a wide range of needs.

In use of the panel of FIG. 1, the panels might be put in place between splicing studs 14 and 15 at each end. The panel facing sheets overlap the splicing stud which is received between the sheets at the panel edge and suitable connectors or other means might be applied to bond the two together. In the discussion below with regard to FIGS. 1 to 11 is set out a use of the panel in an essentially timber framed house. It will be appreciated by those skilled in the art that steel or aluminium could be substituted for the timber with erection of a building using the panels being progressed in essentially the same way.

In use of the panel 10 of FIG. 1, the spacers may extend the full length of the panel. When a plastic foam is used as a spacer, the foam is readily removed at the ends and timbers may be laid up therein to complete a timber frame therein. The shear connector of FIG. 2 provides a convenient means of interconnecting timber framework.

Figure 2:
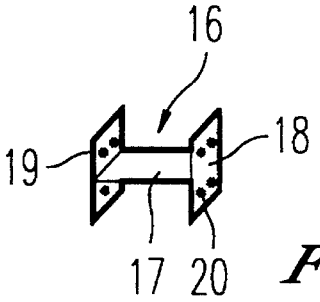

In FIG. 2, the shear connector 16 comprises a web 17 between opposed plates 18 and 19. The opposed plates may be provided with a pattern of holes 20 for the passage therethrough of nails or the like to fix the shear connector 16 between timber studs and plates to frame a building as set out in FIGS. 3 and 4.

Figure 3:
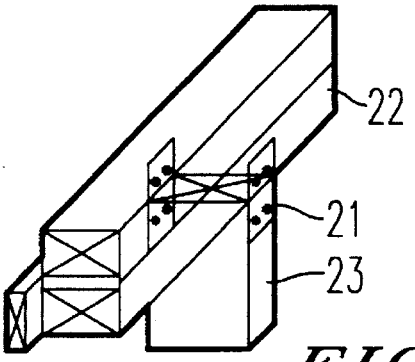
Figure 4:
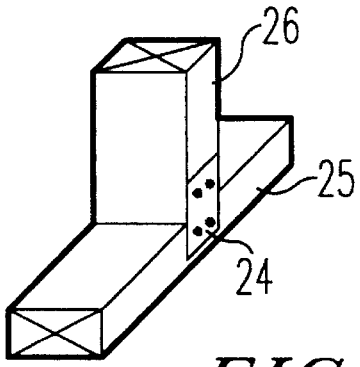

In FIG. 3 a vertical stud 23 is capped by a shear connector 21 and a top plate 22 is laid thereover. When connectors such as nails are in place the stud and top plate are locked together. In FIG. 4, the shear connector 24 does the same job between stud 26 and bottom plate 25.

Figure 5:
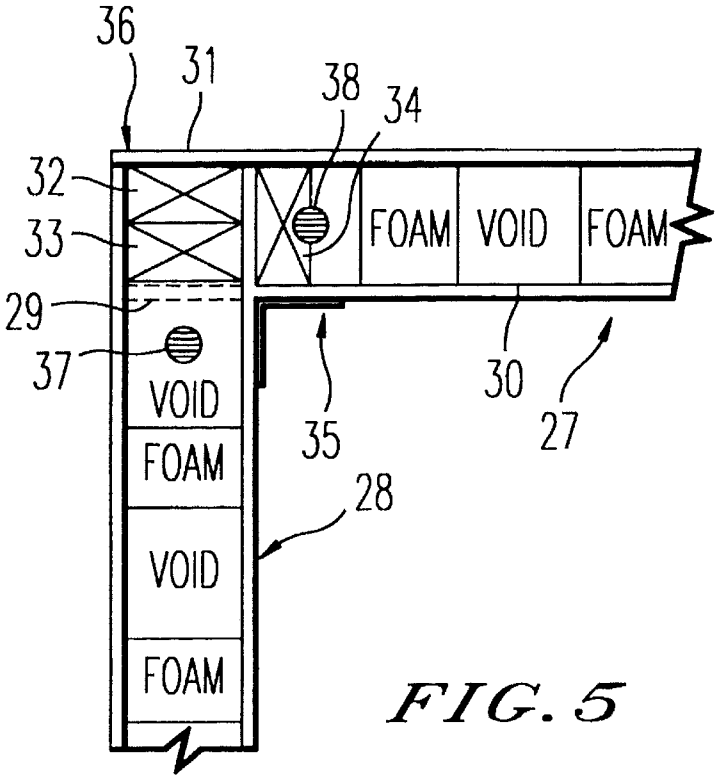

FIG. 5 is a horizontal section through a corner of a building using the above described panels. In putting up the building the panel 28 is stood at the corner, in from the corner the thickness of facing sheet 31 of panel 27. The foam end stud of sheet 28 is removed and a cyclone anchor rod 37 might be fitted in place. Corner timber is then put in place and conveniently two studs 32 and 33 can be used. Then panel 27 is prepared with its foam end stud removed and its face sheet 30 cut back to remove dotted length 29 so that panel 27 might be put in place as illustrated. The stud 34 can be put in place after any cyclone anchor rod 38, as required. The corner can be finished internally with tape 35 over the joint, or by use of any desired molding, etc. The external joint might be sealed with an angle molding 36 as desired to cover over the joint between facing sheet 31 on panel 27 and panel 28.

Figure 6:
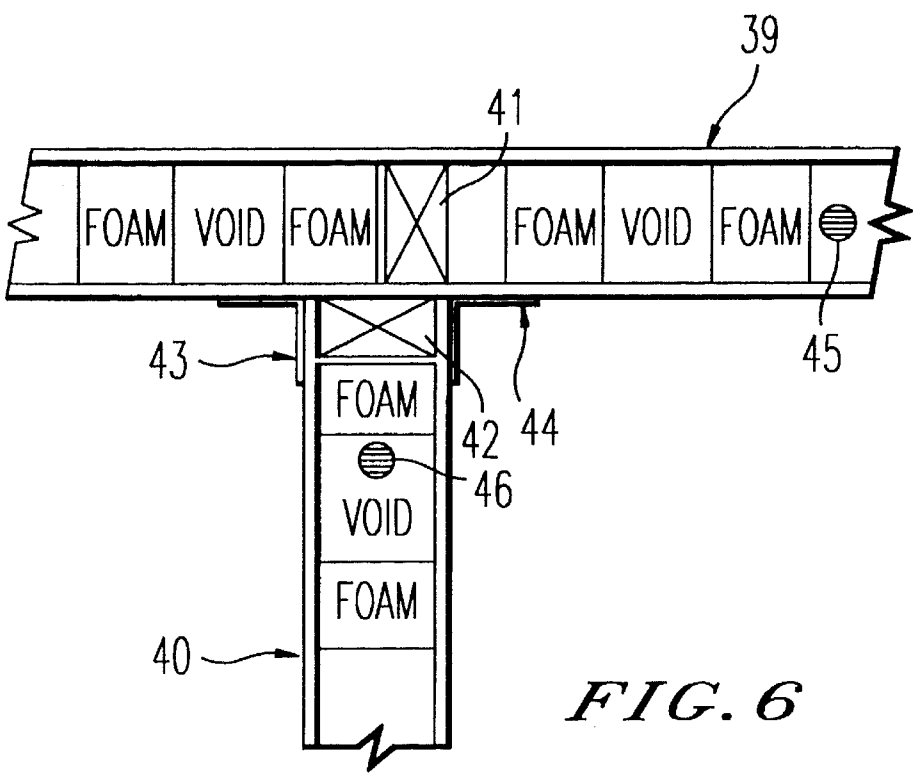

FIG. 6 is a horizontal section through a wall showing how an internal panel 40 might meet an external or other internal wall perpendicularly. At the joint, a stud 41 is put in place in panel 39. At the corner where panel 40 is to be applied, a butt stud 42 can be nailed to stud 41. Then panel 40 may be placed as illustrated and fixed to the butt stud 42 by suitable means. The internal corners 43 and 44 might be taped or otherwise treated as above. When required, tie down rods 45 and 46 may be put in place in voids in the respective panels 39 and 40.

Figure 7A:
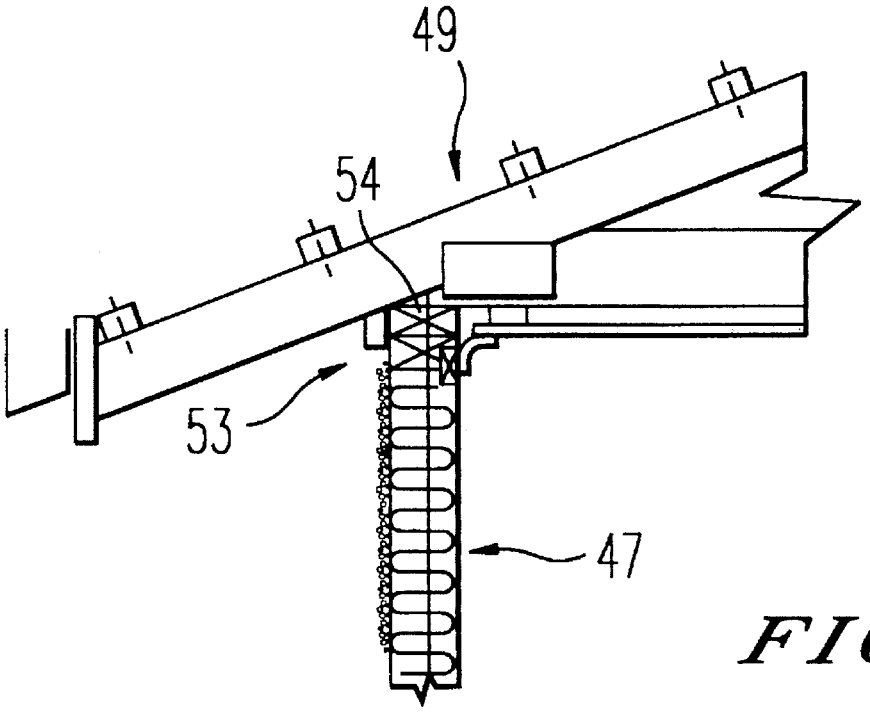
Figure 7B:
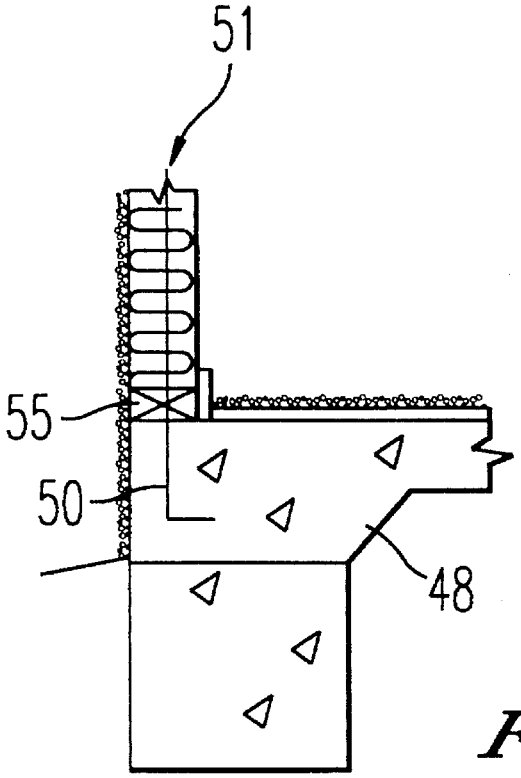

FIG. 7 is a vertical section through a wall made with the above described panel. The panel 47 is stood over a slab floor 48 extended to a roof 49. An anchored reinforcement 50 projected out of slab 48 is connected to tie down rod 51 which is attached at 53 to a top plate 54 carrying roof 49. At the base of the wall a bottom plate 55 is connected to vertical studs (not shown) with shear connectors of the type described with regard to FIG. 2. The bottom plate may overlay a flashing at the slab edge of the usual form to control moisture at the bottom of the wall. Sealants might be added as required. The external surface of panel 47 might be provided with any of the standard surface finishes as desired.

Figure 8:
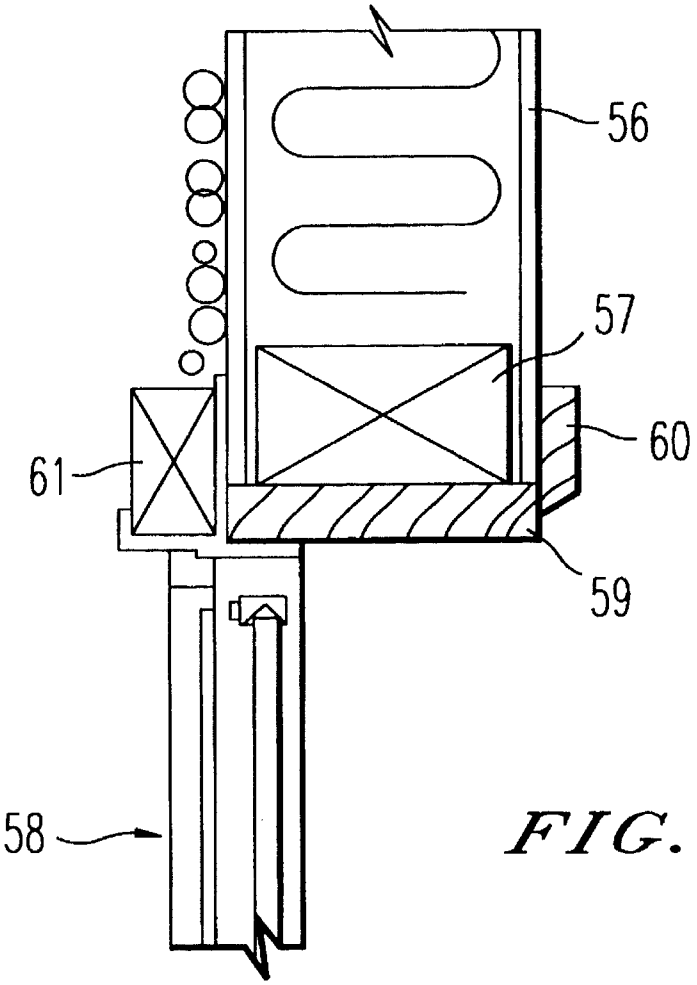

FIG. 8 is a vertical section through a wall above a window opening. Panel 56 is cut back, or extends to, the window level to create an opening into which a window 58 may be fitted. The foam studs of panel 56 are broken out and a timber length 57 inserted. The usual reveal 59 can then be put in place and the window inserted. Any of the usual finishes might be applied such as architrave 60 and external trim 61.

Figure 9:
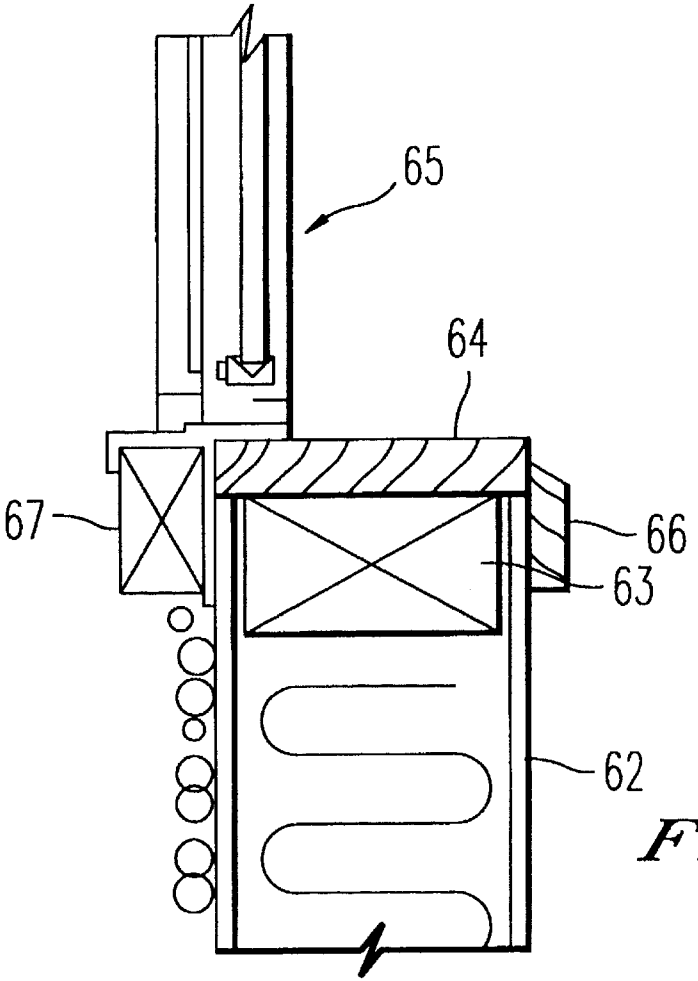

FIG. 9 is a vertical section through the wall at the base of the window. The panel 62 reaches to the window sill, its internal foam studs are broken out, and timber 63 is put in place. The reveal 64 is put in place, the window 65 is fitted, and trims 66 and 67 may be added.

Figure 10:
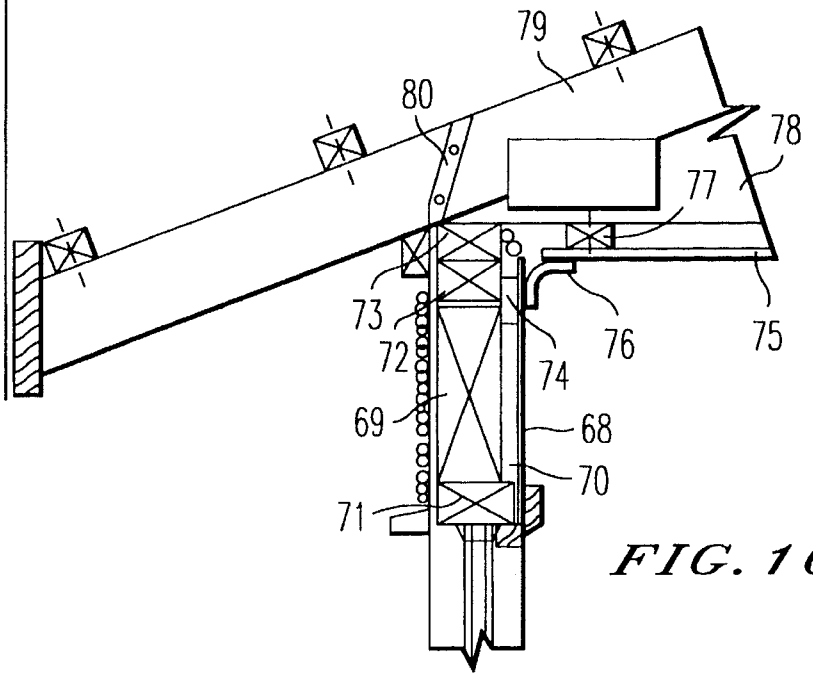

FIG. 10 is a vertical section through a wall at the roof to illustrate the use of the above described panel in a single skin wall. In FIG. 10, panel 68 has its foam studs broken away to form an opening 70 in which a perimeter beam can be established. A beam 69 might be placed above a head trimmer 71 beneath top plates 72 and 73 which can be tied down to bottom plates, slab base, etc. as described above. Spacers 74 might be put in place to support the inner facing sheet at the upper edge. A corner piece 76 may be fitted beneath a ceiling sheet 75 on battens 77 beneath rafters 78 carrying roof truss 79 tied by straps 80 to the top plates 72 and 73.

Figure 11:
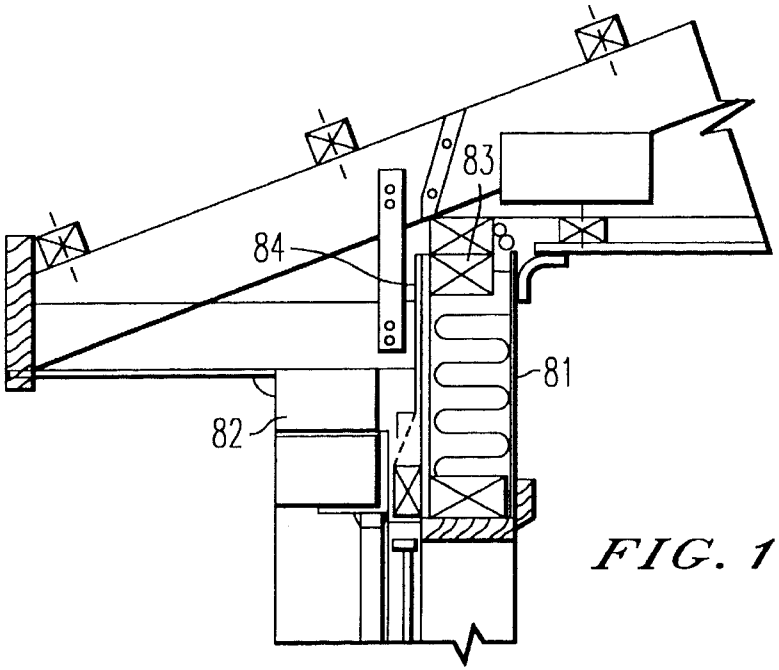

FIG. 11 is a vertical section through a wall at the roof to illustrate the use of the above described panel in a brick veneer wall. In FIG. 11, panel 81 is internally located of an external brick wall 82. The panel 81 is framed as is usual in a brick veneer construction to provide a structural framework. Top plates 83 might be mounted together with steel beam 84 to create a perimeter beam.

The above described building is essentially a timber framed construction utilizing the panel of the present invention. In the below described construction, the building is essentially concrete so far as its structural characteristics are concerned.

Figure 12:
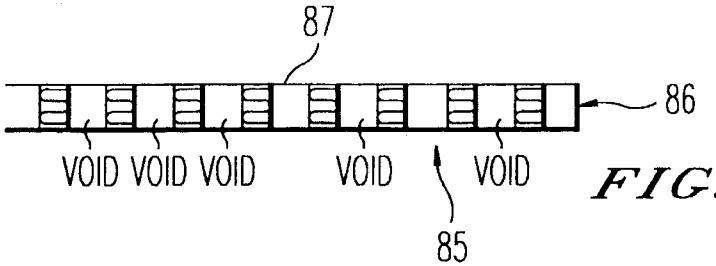

FIG. 12 illustrates a transverse section through a panel 85 having the character set out above. To join panels channel connectors such as 86 may be applied as required between the facing sheets of the panel at points around the panel. The channel connector is shown in greater detail in FIG. 14. The voids 87 of this panel are filled with concrete as will be described below in creating a building using the panel 85.

Figure 13:
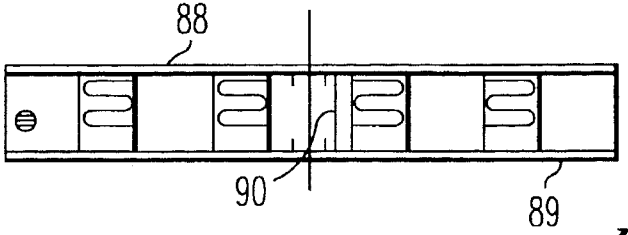

FIG. 13 is a transverse section through an edge-to-edge connection of two panels 88 and 89 with a channel connector 90 therebetween. Channel connectors might be applied along such an edge at 600 mm centers and screws or other suitable means might be used to join the panels thereto. After pouring concrete into the voids, the screws might be removed.

Figure 14:
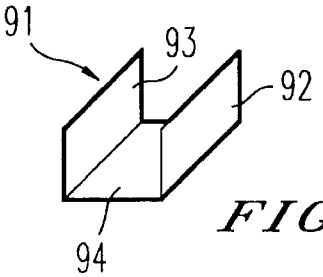

FIG. 14 shows the features of a channel connector 91 with a U- or C-shaped cross-section. Side plates 92 and 93 are at right angles to web 94.

Figure 15:
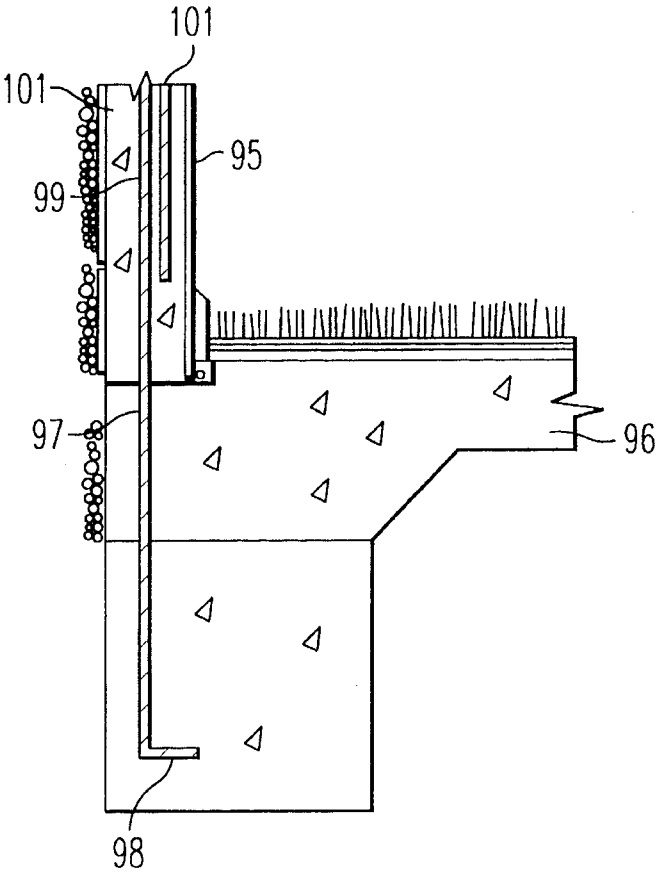
FIGS. 12 to 18 show various sections through panels and walls in another embodiment of the invention wherein concrete provides for load bearing.

FIG. 15 is a vertical section through the base of a wall of a building. Panel 95 is stood over the edge of a slab 96 which has a reinforcement 97, one end 98 embedded in the footing of the slab 96 and the other end 99 projected above into a void in panel 95. A rod 100 can be added in the void of the panel 95 to overlap the end 99. When concrete is poured into the void 101, the column is reinforced for all its vertical length. Rod 100 provides a means to tie down a roof structure.

Figure 16:
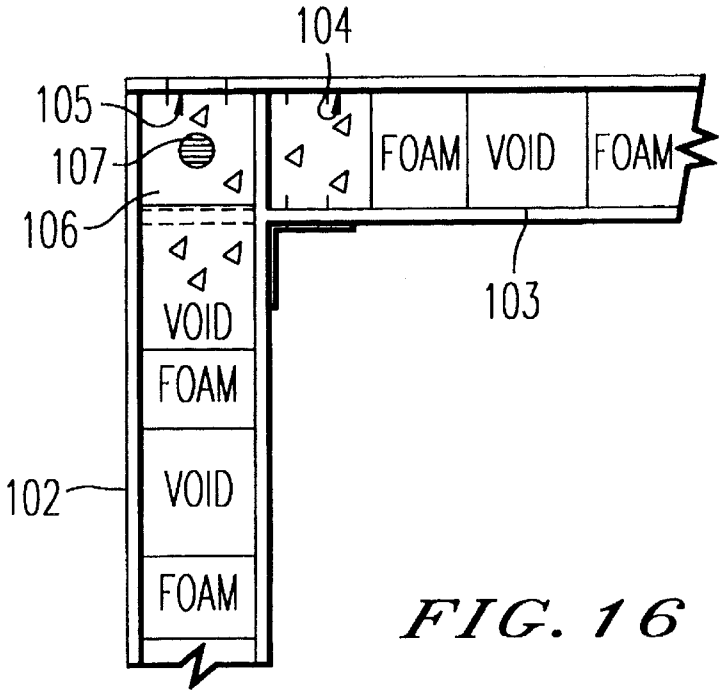

FIG. 16 is a horizontal section through a corner between two panels 102 and 103. These are cored out and formed at their edge as before except that channel connectors 104 and 105 are used to connect the panels in such a way that a void 106 exists at the corner where timber studs were used above. A rod 107 might be put in place prior to pouring concrete into the void to establish a column as a structural element at the corner. The inside corner might be taped as above and the outside provided with a protective molding as above.

In production of a concrete wall as in FIG. 16, not every void needs be filled. Voids might be core filled at 1800 mm centers depending on loadings. It is possible to fill all voids, to interconnect columns in adjoining voids by leaving gaps in foam studs so as to enable cross flow and creation of a web of interlinked concrete columns. It will be clear to one skilled in the art that the choice of column spacing is a matter of engineering, to be decided at each application of the panels.

Figure 17:
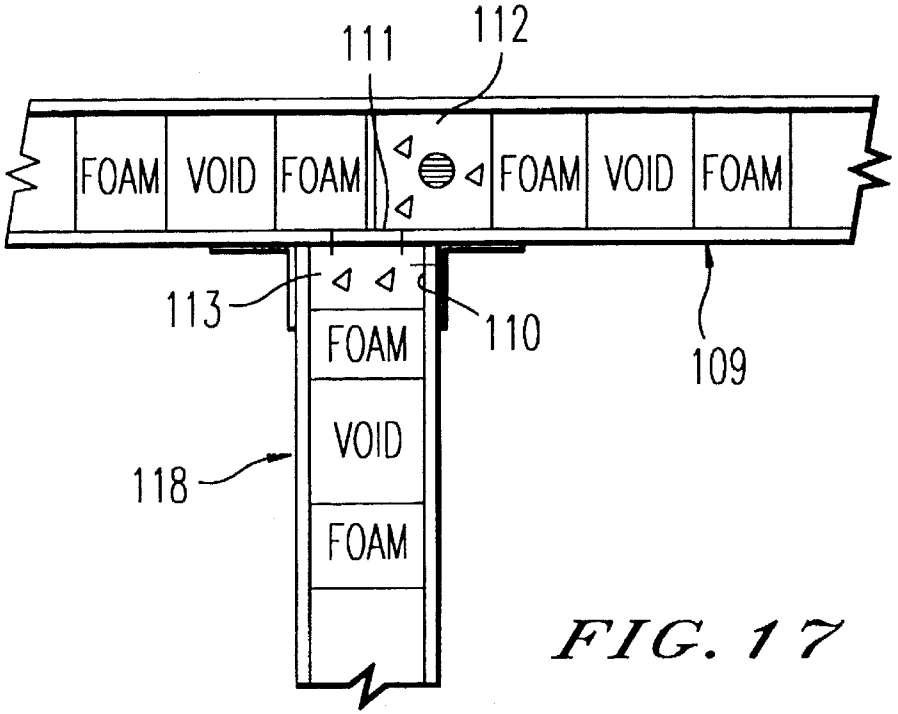

FIG. 17 is a horizontal section through the joint between panel 108 meeting panel 109 at right angles. Channel connectors 110 are attached to panel 109 at typically 600 mm centers up the panel's height. The end stud of panel 108 is removed to enable its facing sheets to mate over the projecting channel connectors. Prior to putting panel 108 in place, the facing sheet of 109 might be punched at points up its height at 111 to communicate the voids 112 and 113 so that when concrete is poured therein it sets and bonds the two walls together.

Figure 18:
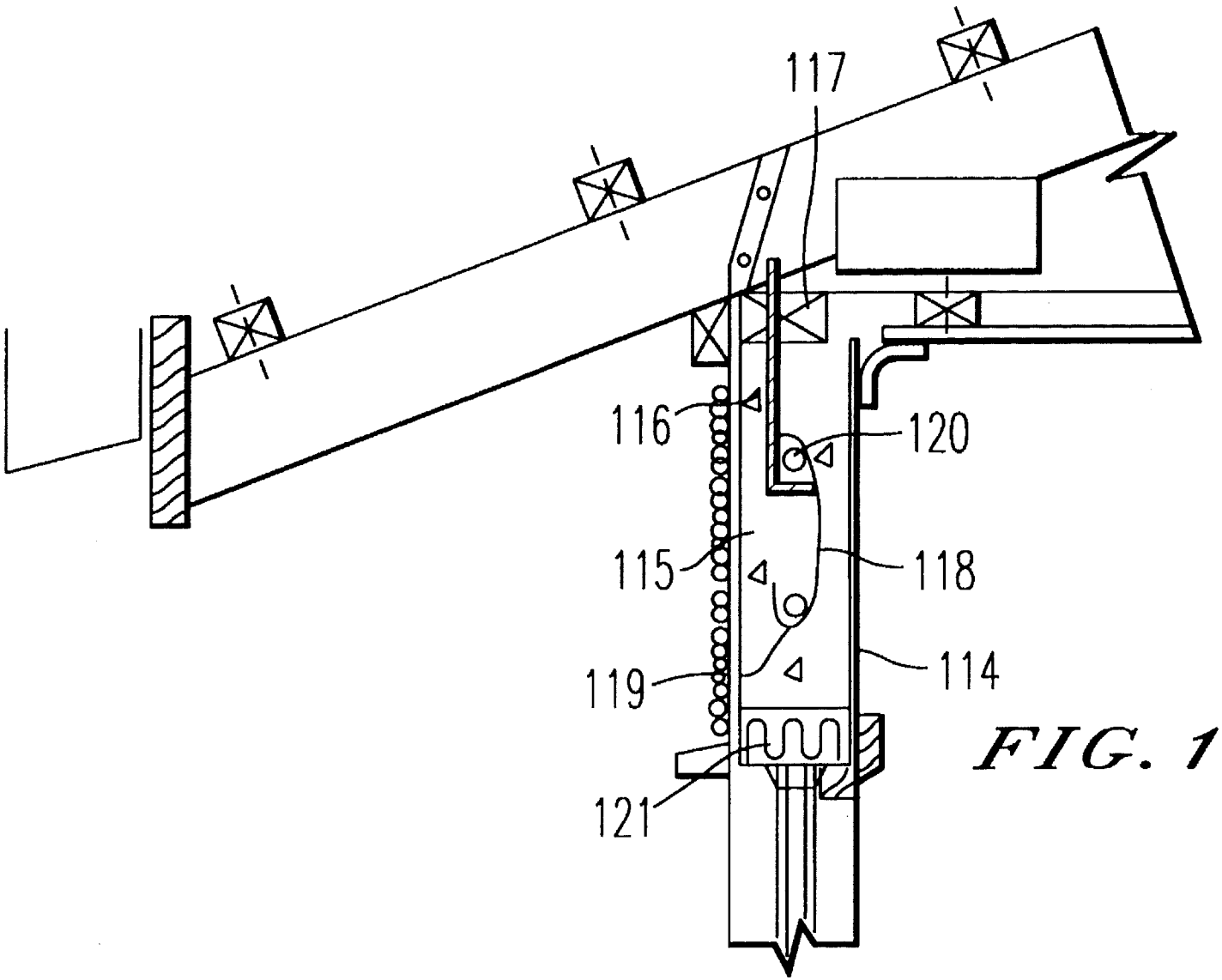

FIG. 18 is a vertical section, at roof level, through a wall with panel 114 cleaned out to a suitable depth of its foam studs to create a volume 115 which can be filled out with concrete to create a perimeter beam. Reinforcements 116 might be hung therein at suitable centers to support reinforcements 119 and 120, extended through the beam, held in place initially by stirrups such as 118 as will be clear to those skilled in the art. Foam pieces 121 might be laid in the base of volume 115 to control flow of concrete and form the beam. The reinforcement 116 may pass through a top plate 117 and anchor it and provide the base for a roof constructed in the usual manner.

In the above described and illustrated panels, channels are provided in one direction only. Clearly, channels could be established in the orthogonal direction to provide additional passages through which building services might be threaded.

With a sufficiently closely spaced set of channels, doors and windows are readily established by cutting the panels to provide a hole into which a window might be inserted, the hole extending between channels through which vertical supports can be dropped to be exposed at the edges of the hole. The exposed supports then provide points at which a window frame, for example, can be attached. Clearly a modular approach is enabled by careful spacing of channels in relation to present widths of doors and windows.

Figure 19:
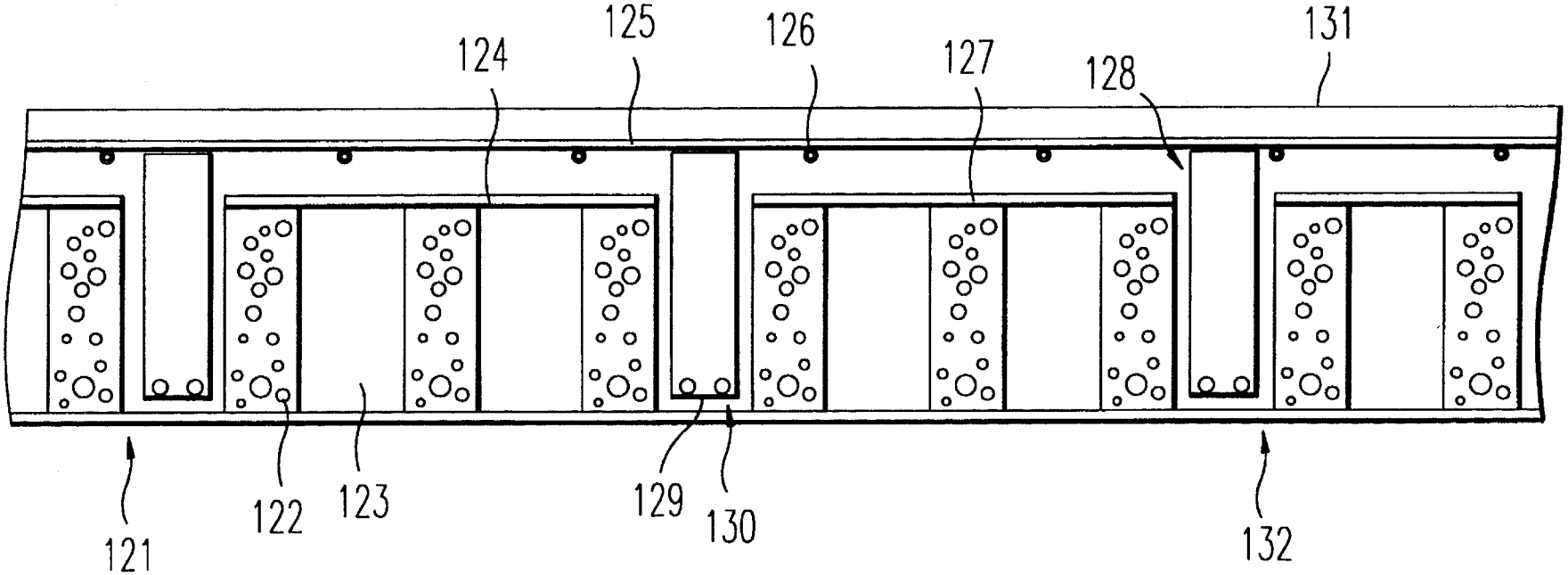
FIG. 19 shows the manner of use of a panel in accordance with the present invention so as to establish a floor ceiling or roof.

In FIG. 19, the panel 121 is used in construction of a floor, roof or ceiling. Panel 121 is supported to constitute formwork for a concrete pour as described below. Core 121 can comprise the aforementioned panel with cores such as 122 with spaces such as 123 therebetween. The top sheet 124 of panel 121 may be cut away at points such as 128 to open spaces in the panel. Reinforcing steel such as the usual mesh comprised of crossed elements such as 125 and 126 may be laid up over the panel with reinforcing rods such as 130 hung in the spaces on ligatures such as 129. With the reinforcing in place concrete may be poured over the panel 121 into its exposed spaces to a level 131 to create a slab floor with beams thereunder. The lower face 132 of panel 121 may be provided with any suitable finish to suit the use of the floor or ceiling. In a multi-storey building the floor might double as a ceiling for a room below. If needed, the panel 121 might be supported in the same manner as standard formwork. It will be clear that the panel might not be horizontal, it might be sloped to provide run-off when used as a roof.

Figure 20:
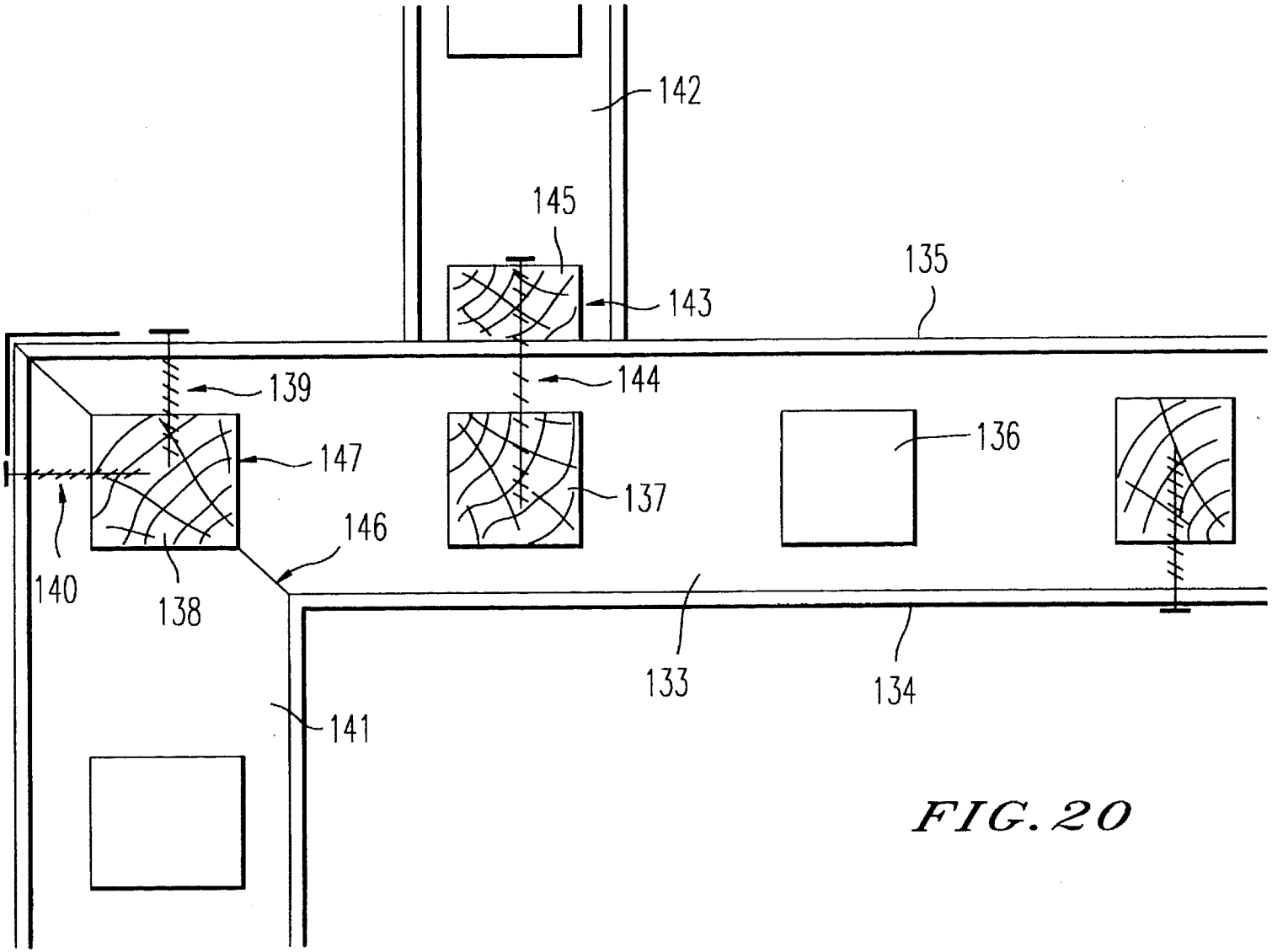
FIG. 20 shows an alternate panel type and how it is used.

FIG. 20 shows an alternate form of panel 133 and its method of use which is basically the same as before. In panel 133, facing sheets 134 and 135 are spaced apart by a core in which voids 136 are formed with dimensions smaller than the core width. The voids might be cut from a foam core by a hot wire technique or the voids might be formed in a process of extrusion, etc. As before, the voids permit the passage of elongate members such as 137. The corner might be bevelled at the corner 146 with a recess 147 to receive a member 138 into which might be applied connectors such as 139 and 140 to fix panels 133 and 141 thereto. A side panel 142 is fitted over batten 145 nested in a cut out 143 with a connector 144 through the batten 145 into member 137.

Figure 21:
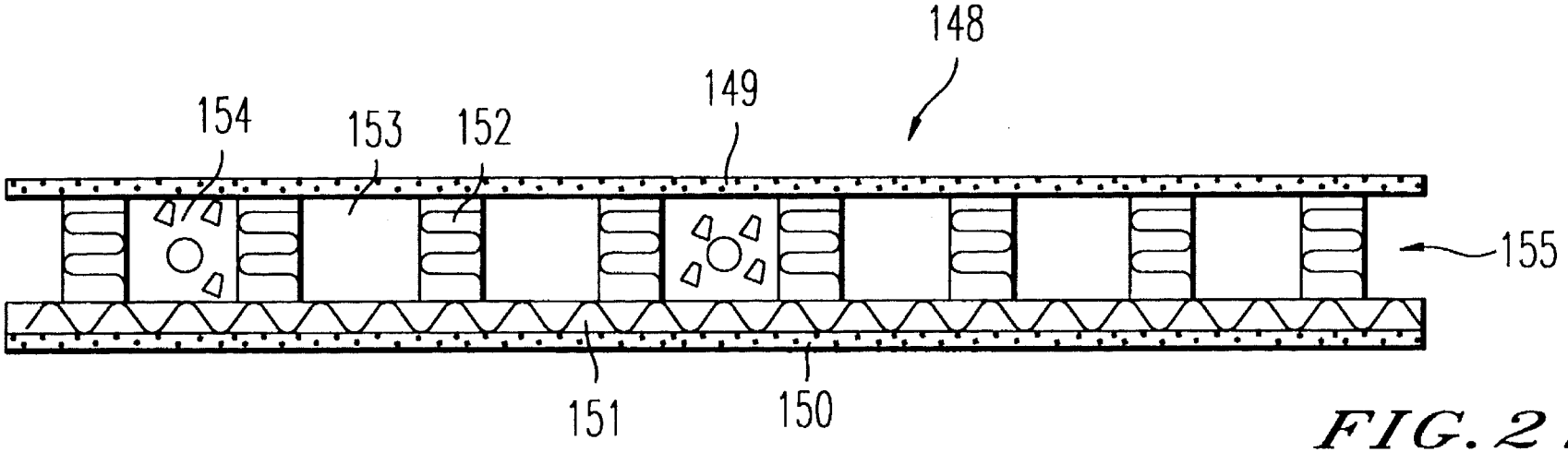
FIGS. 21 and 22 show sections through two further embodiments of the panel.

The panel 148 of FIG. 21 has facing sheets 149 and 150 spaced apart by a core which incorporates a layer 151 between facing sheet 150 and the spacer blocks such as 152 which are spaced apart to leave voids such as 153 into which elongate framing element, or concrete 154, may be inserted as above. The facing sheets and spacer blocks may be as above described. The extra sheet 151 exists for insulation such as insulation against heat flows where that is to be avoided. The thickness of layer 151 will be determined by the degree of insulation required as will the material. A foam material will provide useful insulation against heat flow across the slab.

Figure 22:
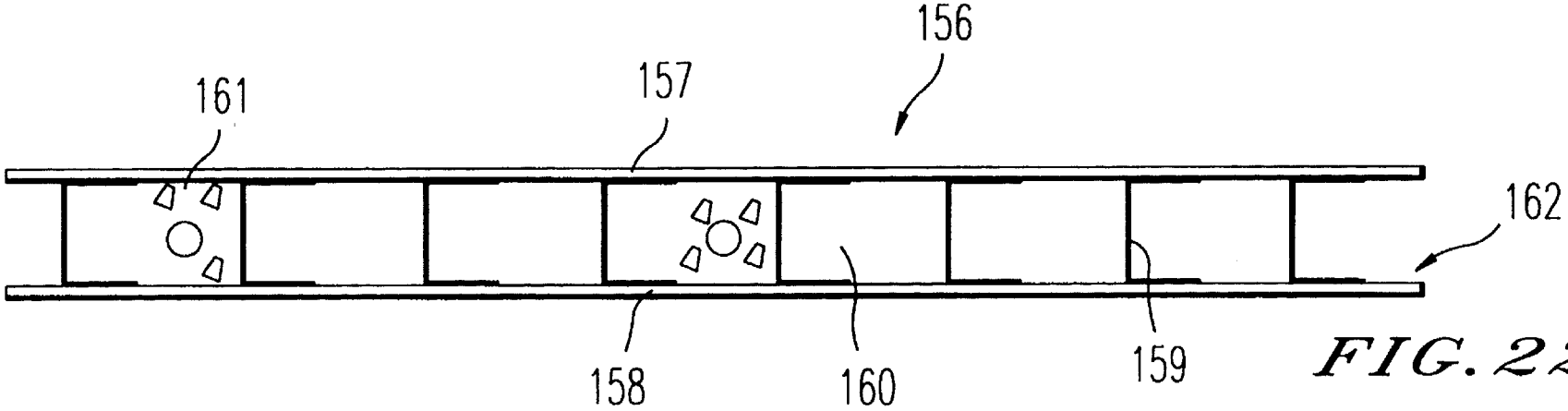

The panel 156 of FIG. 22 shows a panel which is structured to achieve a useful fire rating. Outer sheets 157 and 158 are spaced by C-shaped elongate members or studs 159 leaving voids 160 therebetween into which concrete 161 can be poured, as above. A careful choice of facing sheet materials with, say, steel studs, will achieve a degree of fire resistance which will increase if the panel is filled out with concrete. This kind of wall might be used for common and party walls where a fire rating, and particularly a sound rating are required. This panel, when filled out with concrete, will insulate against sound transmission.

We claim:

1. A building comprising a plurality of panels wherein said panels comprise:

first and second facing sheets which define the height and width of the panel; and core means located therebetween;

the first and second sheets being bonded to the core means and spaced thereby wherein the core means is crossed by a plurality of channels, spaced apart across the width of the panel and each extended across the height of the panel from edge to edge thereof and the core means is recessed from the edges of the facing sheets;

wherein the panels are one of being butted together edge to edge and being butted together edge to face, the intervening facing sheet is holed to interconnect a channel to the recessed edge, the butted panels enclosing respective spaces therebetween; and the upper recessed edges and the spaces enclosed between panels are filled with concrete forming vertical structural supporting elements and an upper integral peripheral edge beam.

2. A building as claimed in claim 1 wherein said concrete additionally extends through one or more channels within the panels and is integral with the peripheral edge beam.

3. A building as claimed in claim 1 wherein an edge-to-edge connection of adjoining panels comprises U-shaped connectors bridged between the panels and wherein the space therebetween is filled with concrete.

4. A building as claimed in claim 1 wherein an edge-to-face connection of adjoining panels comprises a U-shaped connector attached to the face of one panel by a base of the U-shaped connector, overlying a channel formed therein, the arms of each U-shaped connector are located in an edge recess of the adjoining panel and the channel and the recess are filled throughout by a body of concrete extending through holes in the intervening facing sheet.

5. A building as claimed in claim 1 wherein at least one panel stands over a concrete slab at the edge thereof with a reinforcement extending from the slab into one of a concrete filled space and a channel of the panel.

6. A building as claimed in claim 5 wherein a vertically extended reinforcement passes through one of the space and channel into the peripheral edge beam.

7. A method of constructing a building using preformed panels, said preformed panels comprising first and second facing sheets which define the height and width of the panel; and core means located therebetween, the first and second sheets being bonded to the core means and spaced thereby, wherein the core means is crossed by a plurality of channels, spaced apart across the width of the panel and each extended across the height of the panel from edge to edge thereof and the core means is recessed from the edges of the facing sheets, which comprises:

butting together selected ones of the panels wherein the panels are one of butted together edge to edge and butted together edge to face, and wherein the intervening facing sheet is holed to interconnect a channel to the recessed edge of the butted panel, said panels enclosing respective spaces therebetween; and filling the upper recessed edges and the spaces enclosed between the panels with concrete forming vertical structural supporting elements and an upper integral peripheral edge beam.

8. The method of building as claimed in claim 7 which comprises positioning a concrete reinforcement in the upper recessed edges and pouring concrete to form a structural beam therein.

9. The method of constructing a building as claimed in claim 7 which comprises additionally flowing the concrete through at least one channel within the panels to form additional structural supports which are also integral with the peripheral edge beam.

10. The method of constructing a building as claimed in claim 7 which comprises standing the panels edge-to-edge with U-shaped connectors bridged between the panels so as to leave the space therebetween free for the flow of the concrete.

11. A method of constructing a building as claimed in claim 7 which comprises standing the panels edge-to-face with U-shaped connectors attached to the face of one panel by respective bases of the panels, overlying a channel, wherein the arms of each U-shaped connector are located in an edge recess of an adjoining panel and the channel and filling the recess throughout by concrete flowing thereto and through holes formed in the intervening facing sheet.

12. A method of constructing a building as claimed in claim 7 which comprises standing a plurality of the panels edge-to-edge over a concrete slab with reinforcements projected therefrom which enter into at least one of said spaces and said channels and filling said spaces and channels with reinforcements therein with concrete so as to be integral with a perimeter beam.

13. A building as claimed in claim 12, wherein said concrete additionally extends through one or more channels within the panels and is integral with the peripheral edge beam.

14. A building as claimed in claim 12 wherein an edge-to-edge connection of adjoining panels comprises a U-shaped connector bridged between the panels and wherein the space therebetween is filled with concrete.

15. A building as claimed in claim 12, wherein an edge-to-face connection of adjoining panels comprises a U-shaped connector attached to the face of one panel by a base of the U-shaped connector, overlying a channel formed therein, the arms of each U-shaped connector are located in an edge recess of the adjoining panel and the channel and the recesses are filled throughout by a body of concrete extending through holes in the intervening facing sheet.

16. A building comprising a plurality of panels wherein said panels comprise:

first and second facing sheets which define the height and width of the panel; and a core located therebetween;

the first and second sheets being bonded to the core and spaced thereby wherein the core is crossed by a plurality of channels, spaced apart across the width of the panel and each extended across the height of the panel from edge to edge thereof and the core is recessed from the edges of the facing sheets;

wherein the panels are one of being butted together edge to edge and being butted together edge to face, the intervening facing sheet is holed to interconnect a channel to the recessed edge, the butted panels enclosing respective spaces therebetween; and the upper recessed edges and the spaces enclosed between panels are filled with concrete forming vertical structural supporting elements and an upper integral peripheral edge beam.

17. A building as claimed in claim 16, wherein at least one panel stands over a concrete slab at the edge thereof with a reinforcement extending from the slab into one of a concrete filled space and a channel of the panel.

18. A building as claimed in claim 17, wherein a vertically extended reinforcement passes through one of the space and channel into the peripheral edge beam.

19. A method of constructing a building using preformed panels, said preformed panels comprising first and second facing sheets which determine the height of the panel and a core located therebetween;

the first and second sheets being bonded to the core and spaced thereby, wherein the core is crossed by a plurality of channels, spaced apart across the width of the panel and each extended across the height of the panel from edge-to-edge thereof and the core is recessed from the edges of the facing sheets, which comprises:

butting together selected ones of the panels wherein the panels are one of butted together edge-to-edge and butted together edge-to-face, and wherein the intervening facing sheet is holed to interconnect a channel to the recessed edge of the butted panel, said panels enclosing respective spaces therebetween; and filling the upper recessed edges and the spaces enclosed between the panels with concrete forming vertical structural support elements and an integral peripheral edge beam.

20. The method of building as claimed in claim 19, which comprises positioning a concrete reinforcement in the upper recessed edges and pouring concrete to form a structural beam therein.

21. The method of constructing a building as claimed in claim 19, which comprises additionally flowing the concrete through at least one channel within the panels to form additional structural supports which are also integral with the peripheral edge beam.

22. The method of constructing a building as claimed in claim 19, which comprises standing the panels edge-to-edge with U-shaped connectors bridged between the panels so as to leave the space therebetween free for the flow of the concrete.

23. The method of constructing a building as claimed in claim 19 which comprises standing the panels edge-to-face with U-shaped connectors attached to the face of one panel by respective bases of the panels, overlying a channel, wherein the arms of each U-shaped connector are located in an edge recess of an adjoining panel and the channel and filling the recess throughout by concrete flowing thereto and through holes formed in the intervening facing sheet.

24. A method of constructing a building as claimed in claim 19 which comprises standing a plurality of the panels edge-to-edge over a concrete slab with reinforcements projected therefrom which enter into at least one of said spaces and said channels and filling said spaces and channels with reinforcements therein with concrete so as to be integral with a perimeter beam.

* * * * *

UNITED STATES PATENT AND TRADEMARK OFFICE

CERTIFICATE OF CORRECTION

PATENT NO. : 5,526,625

DATED : June 18, 1996

INVENTOR(S) : Alan G. EMBLIN, et al.

It is certified that error appears in the above-indentified patent and that said Letters Patent is hereby corrected as shown below:

On title page, add item [30], "Foreign Application Priority Data" to read as follows:

--Sep. 24, 1991 [AU] Australia.....PK 8548
Dec. 23, 1991 [AU] Australia.....PL 0201
Apr. 28, 1992 [AU] Australia.....PL 2132
Jun. 2, 1992 [AU] Australia.....PL 2735--

Signed and Sealed this

Tenth Day of September, 1996

*Attest:*

*Attesting Officer*

BRUCE LEHMAN

*Commissioner of Patents and Trademarks*